US010660447B2

(12) United States Patent
Polevoy et al.

(10) Patent No.: US 10,660,447 B2
(45) Date of Patent: May 26, 2020

(54) THREE DIMENSIONAL CONNECTION SYSTEM FOR BED FRAME

(71) Applicants: Richard S. Polevoy, Teaneck, NJ (US); Paul E. Carlson, Skaneateles, NY (US); Michael W. Konieczny, Skaneateles, NY (US); Robert L. Naas, Skaneateles, NY (US)

(72) Inventors: Richard S. Polevoy, Teaneck, NJ (US); Paul E. Carlson, Skaneateles, NY (US); Michael W. Konieczny, Skaneateles, NY (US); Robert L. Naas, Skaneateles, NY (US)

(73) Assignee: Finger Lakes Intellectual Property LLC, Teaneck, NJ (US)

( * ) Notice: Subject to any disclaimer, the term of this patent is extended or adjusted under 35 U.S.C. 154(b) by 0 days.

(21) Appl. No.: 16/102,202

(22) Filed: Aug. 13, 2018

(65) Prior Publication Data

US 2019/0038037 A1 Feb. 7, 2019

Related U.S. Application Data

(63) Continuation of application No. 14/716,072, filed on May 19, 2015, now abandoned.

(60) Provisional application No. 62/000,754, filed on May 20, 2014.

(51) Int. Cl.
*A47C 19/02* (2006.01)
*A47C 19/00* (2006.01)

(52) U.S. Cl.
CPC ..... *A47C 19/025* (2013.01); *A47C 19/005* (2013.01); *A47C 19/024* (2013.01)

(58) Field of Classification Search
CPC ..... A47C 19/00; A47C 19/02; A47C 19/025; A47C 19/005; A47C 19/024; A47C 19/04; A47C 19/12
See application file for complete search history.

(56) References Cited

U.S. PATENT DOCUMENTS

| | | | | |
|---|---|---|---|---|
| 2,203,780 A * | 6/1940 | Gatz | ..... | A47B 25/003 248/165 |
| 3,683,429 A * | 8/1972 | Mis | ..... | A47C 19/024 5/201 |
| 2010/0242171 A1* | 9/2010 | Polevoy | ..... | A47C 19/005 5/282.1 |
| 2016/0007759 A1* | 1/2016 | Polevoy | ..... | A47C 19/024 5/400 |
| 2017/0273468 A1* | 9/2017 | Polevoy | ..... | A47C 19/04 |
| 2018/0296000 A1* | 10/2018 | Polevoy | ..... | F16B 12/44 |
| 2019/0000236 A1* | 1/2019 | Polevoy | ..... | A47C 19/02 |

* cited by examiner

*Primary Examiner* — Robert G Santos
*Assistant Examiner* — Rahib T Zaman
(74) *Attorney, Agent, or Firm* — Hoffmann & Baron, LLP

(57) ABSTRACT

A connection system for use in joining structural members of a bed frame together. One of the structural members has a wedge and the other of the structural members has a cavity formed in a receiver. The wedge has a plurality of exterior surfaces that contact with a plurality of interior surfaces formed in the cavity. The wedge may be comprised of a plurality of wedge segments that enter into a plurality of openings in the receiver. The interfitting of the wedge into the receiver make a solid connection that is enhanced by weight of the bedding positioned thereon. The connection resists twisting forces as well as lateral and fore and aft forces.

18 Claims, 10 Drawing Sheets

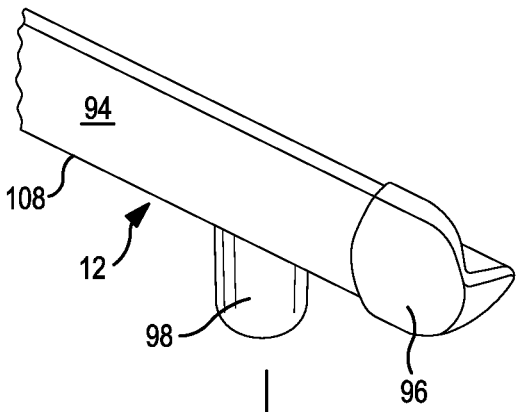
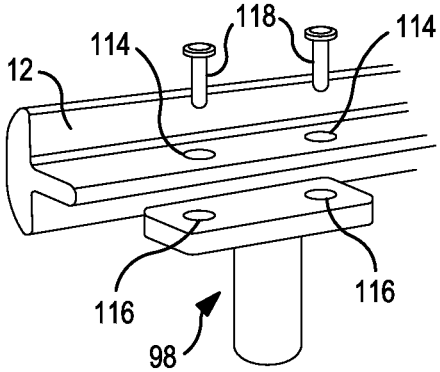
FIG. 8
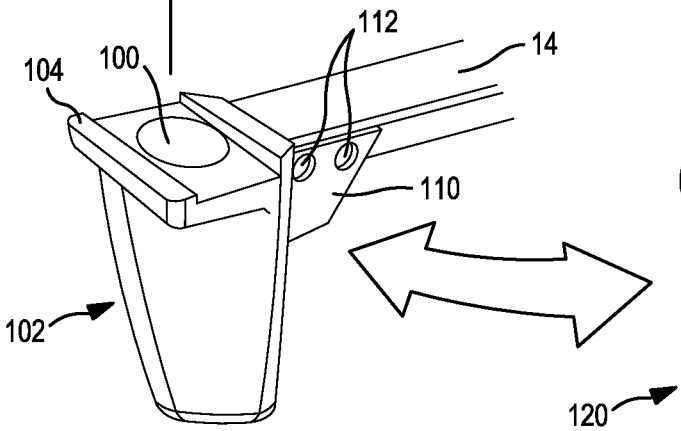
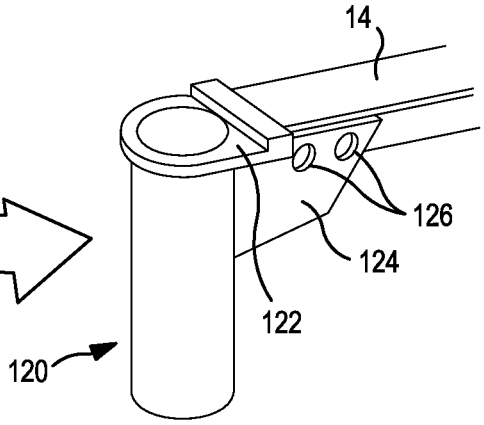
FIG. 7
FIG. 9

THREE DIMENSIONAL CONNECTION SYSTEM FOR BED FRAME

CROSS REFERENCE TO RELATED APPLICATIONS

The present patent application is a continuation of, and hereby claims priority to, application Ser. No. 14/716,072, filed May 19, 2015, entitled Three Dimensional Connection System For Bed Frame, which in turn, claims priority from U.S. Provisional Application Ser. No. 62/000,754, filed May 20, 2014. Applicants claim the benefits of 35 U.S.C. 120 as to said Non-Provisional Application, and the benefits of 35 U.S.C. 120 as to said Provisional Application and the entire disclosures of all application are incorporated herein by reference in their entireties.

FIELD OF THE INVENTION

The present invention relates to a bed frame for supporting a mattress or mattress set and, more particularly, to a bed frame having an improved interconnection system between the side rails and cross members.

BACKGROUND OF THE INVENTION

There are currently in use conventional bed frame assemblies that are used for supporting a mattress or mattress set and such bed frame assemblies are normally made up of two side rails and at least one cross member. The bed frame supports the load of a mattress set by means of multiple support legs.

Due to the difficulties of actually shipping a completed bed frame, conventional bed frames are delivered to the customer in an unassembled state, and then assembled at the site where the bed frame is intended to be located and used. One difficulty with such bed frames and the assembly thereof, however, is that tools may be required for the on site assembly of the bed frames and, therefore, if the tools are not available, the assembly cannot be done. Further, tool assemblies can be difficult and complicated.

There has been published, certain three dimensional systems that can be used to carry out the connecting of a cross member and a side rail and a number of such systems are shown and described in U.S. Patent Application of Polevoy et al, U.S. Published Application 2010/0242171 and entitled "Three Dimensional Connection System For Bed Frame" and the specification of that application is hereby incorporated in its entirety into the present patent application.

In the aforesaid patent application, the components i.e. a wedge and a receiver for the various connections are comprised of a plastic material and the connection is accomplished without the use of tools and therefore the bed frame can be set up readily and conveniently on site.

While the '171 patent publication discloses certain configurations of connecting components to carry out the assembly of a bed frame, there are addition materials and geometric configurations that can also be used to carry out such assembly.

Accordingly, it would be advantageous to provide alternative components for connections between cross members and side rails of a bed frame that are comprised of differing materials and geometric configurations that can be used to assemble a bed frame without the need for tools.

SUMMARY OF THE INVENTION

In accordance with the present invention, there is a system to carry out the connection of two structural components of a bed frame, and, as one exemplary embodiment, the connection between a cross member and a side rail of a bed frame. The present system is usable without the need for tools in the assembly of the bed frame at the site where the bed frame is to be used.

The inventive system creates a robust interconnection between a side rail and a cross member of a bed frame, or other bed frame components by employing a wedge on one of the components and a receiver on the other of the components such that the wedge fits into the receiver. The fit between a wedge and a receiver locks the frame together quickly and securely. The downward pressure of the bedding makes the connection solid and any looseness that might develop is taken away by the automatic and constant resetting of the wedge in the receiver.

The side rails and the cross members are secured together with a tool-less interlock that uses the weight of the supported load to combined the separate parts into one unit. The system forms the connection between the side rail and cross member and also a support leg. The wedge and receiver may be, respectively, on the side rail or cross member or the reverse. The assembly utilizes a three dimensional wedge at the ends of the cross member or side rail to both connect and stabilize the bed frame components.

As used herein, the term "wedge" is used to describe the male member and the term "receiver" used to describe the female member of a connection; however, the terms do not necessarily imply that there must be a taper to either the wedge or the receiver. As will be seen, in at least one exemplary embodiment, the wedge and receiver may both be cylindrical in configuration and therefore neither is tapered. It should also be noted that the term "receiver" used with this invention, in many instances, also serves as a leg for the bed frame.

As such, in a first embodiment of the present invention, a wedge is affixed to a cross rail that is either a formed metal wedge of a cast metal wedge In either case, the wedge is affixed to a cross member.

In a second embodiment, the wedge is comprised of a formed metal or cast metal wedge that is covered by a protective plastic shield. Again, the wedge can be affixed to a cross member.

In a third embodiment, there is a system where the wedge is cylindrical in geometry and which interfits into a cylindrical shaped opening in a receiver. The wedge is affixed to the cross member.

In the fourth embodiment, there is a connection system wherein the wedge is cylindrical but that cylindrical wedge is affixed to the side rail and the cylindrical receiver is, in turn, affixed to the cross member such that the side rail is affixed to the cross member by inserting the wedge on the side rail into the receiver on the cross member.

Lastly, there is an embodiment wherein the wedges comprise a plurality of wedge segments and the receiver has a plurality of openings that receive the wedge segments such that the wedge is basically locked into the receiver as it is inserted therein. In this exemplary embodiment, the receiver is made up of two halves that are affixed together to form the receiver having a plurality of openings.

These and other features and advantages of the present invention will become more readily apparent during the following detailed description taken in conjunction with the drawings herein.

BRIEF DESCRIPTION OF THE DRAWINGS

FIG. 7 is an exploded view illustrating the interfitting of a cylindrical wedge affixed to a side rail into a cylindrical receiver affixed to a cross member;

FIG. 8 is an exploded view illustrating the affixation of the wedge of the FIG. 7 embodiment to a side rail of a bed frame;

FIG. 9 is a perspective view illustrating an alternative receiver to the FIG. 7 embodiment;

DETAILED DESCRIPTION OF THE INVENTION

Figure 1:
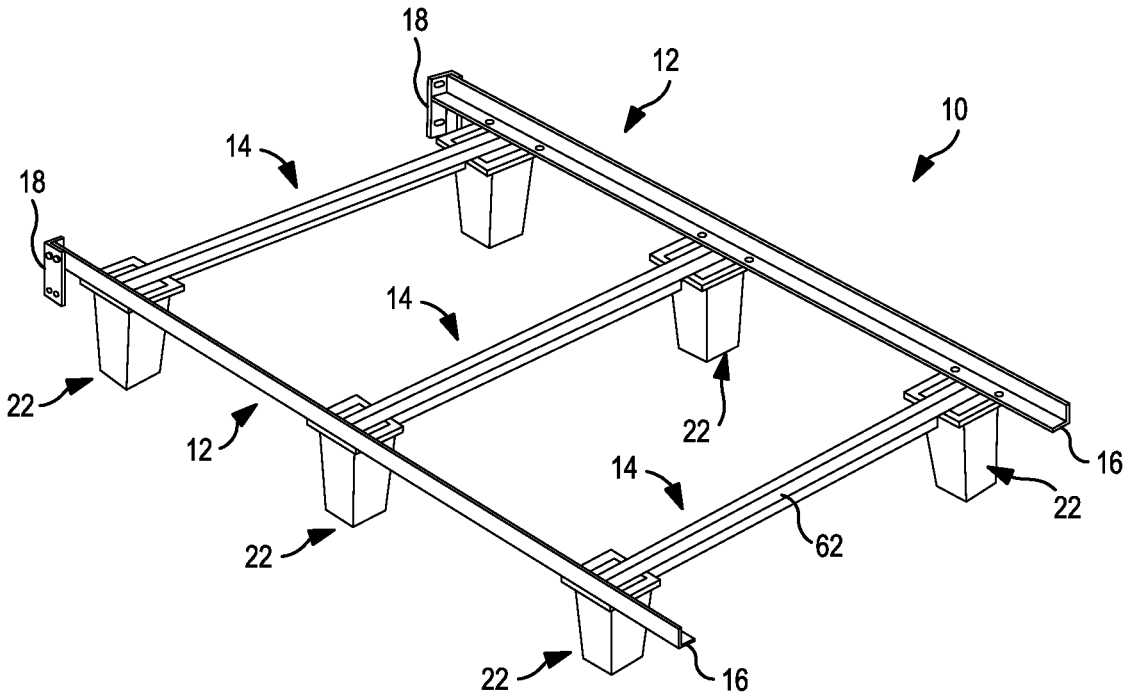
FIGS. 1 and 2 are, respectively, a perspective view and an exploded view, of a bed frame that can utilize the connection system of the present invention.
Figure 2:
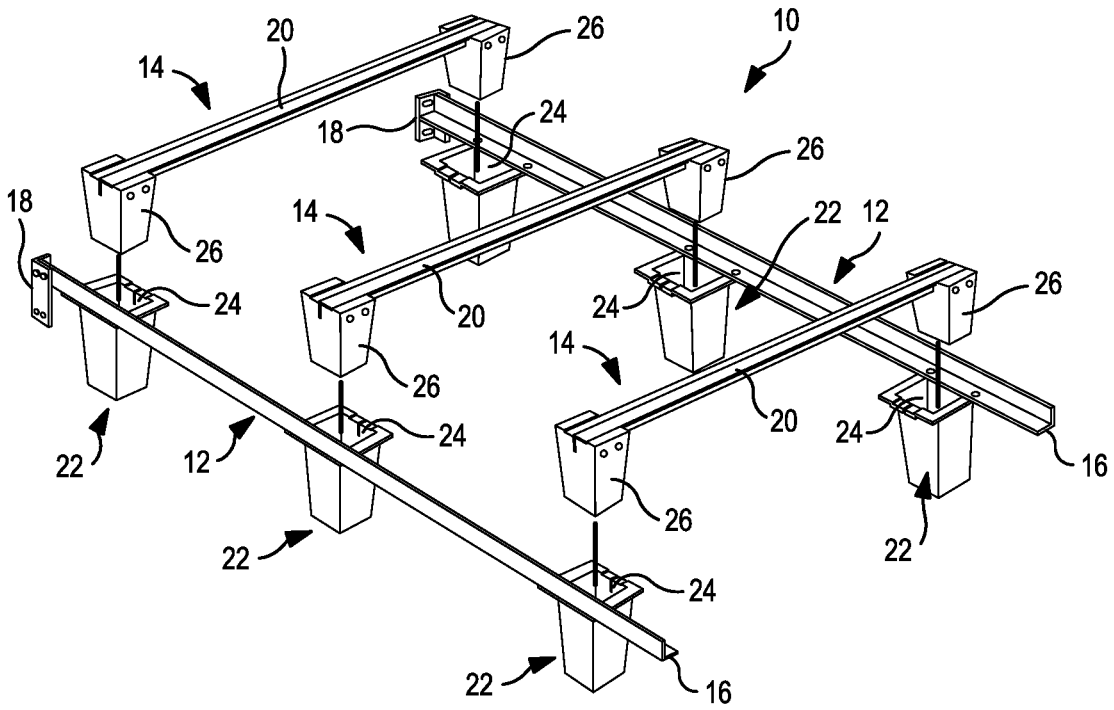

Turning first to FIGS. 1 and 2, there is shown, respectively, a perspective view and an exploded view, of a bed frame 10 and illustrating the three dimensional connection for which the present invention can be utilized. The bed frame 10 of FIGS. 1 and 2 is shown and described in U.S. Patent Pub. 2010/0242171, published Sep. 30, 2010 and entitled "Three Dimensional Connection System For bed Frame" and the disclosure of that patent application is hereby incorporated herein in its entirety. As will become clear, the present invention is directed to certain alternative embodiments of the three dimensional connection system disclosed in the '171 published application.

As can be seen, the bed frame 10 comprises a pair of side rails 12 and a plurality of cross members 14. As shown, there are three cross members 14, however a lesser or greater number of cross members 14 can be used in constructing a bed frame. The side rails 12 are comprised of L-shaped angle irons 16 however in U.S. Pat. No. 7,363,664 there is disclosed the use of a T-shaped member that can be used as a structural member of a bed frame, that is, as either a cross member or a side rail. Each side rail 12 may include an end bracket 18 for affixing thereto, a headboard or a footboard (not shown), The cross members 14 are L-shaped angle irons 20 that will be later described, however the cross members 14 may be T-shaped elongated members that may be constructed of two L-shaped members affixed together or may be unitary T-shaped metal members.

Affixed to each of the side rails 12 are receivers 22 having a female cavity 24 formed therein in a configuration to be later explained. Affixed to the ends of the cross members 14 are wedges 26 that are also constructed in a manner to be later explained.

While the embodiment of FIGS. 1 and 2 illustrate the receivers 22 affixed to the side rails 12 and the wedges 26 affixed to the cross members 14, it will be seen that wedges and receivers may be oppositely affixed, that is, the receivers 22 may be affixed to the cross members 14 and the wedges 26 affixed to the side rails 12.

Figure 3A:
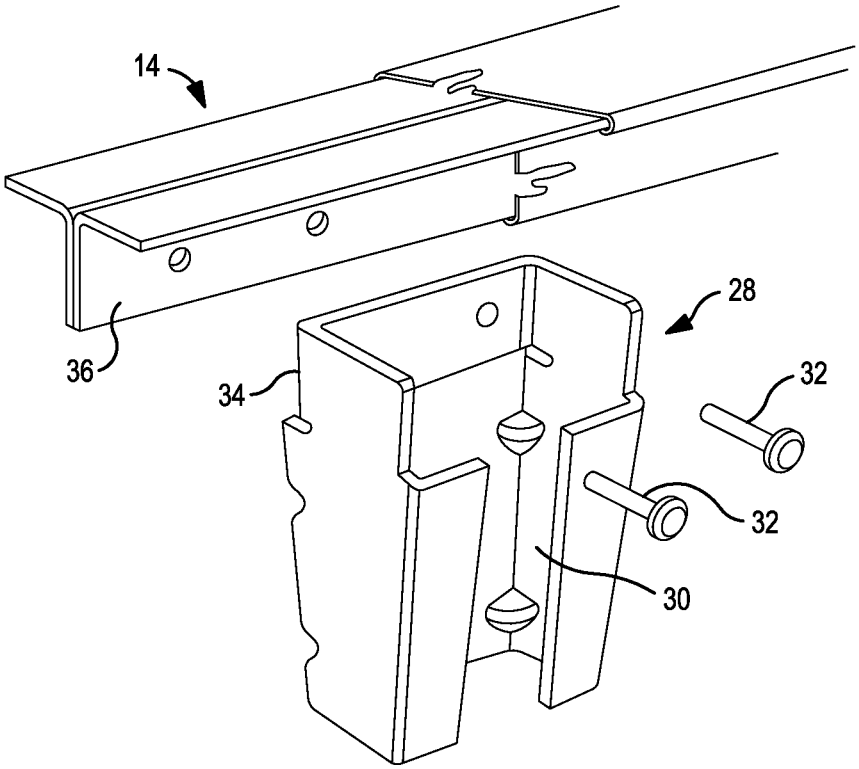
FIG. 3A is an exploded view illustrating the affixation of a formed metal wedge to a cross member and FIG. 3B is a perspective view of a cast metal wedge usable with the embodiment.
Figure 3B:
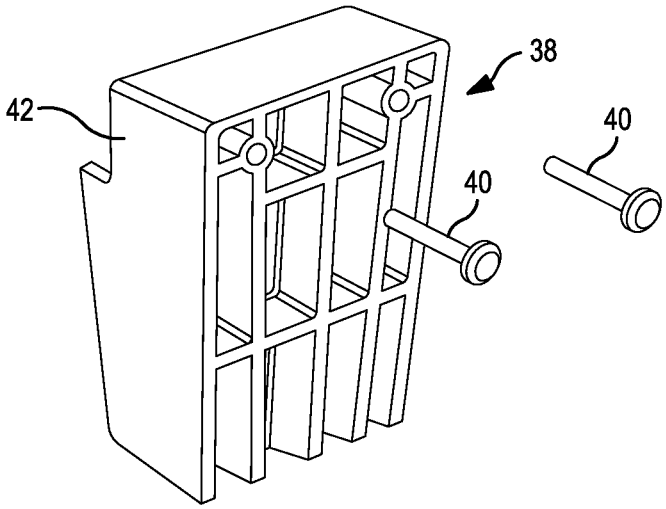

Turning then to FIGS. 3A and 3B, there is shown, respectively, an exploded view illustrating the affixation of a formed metal wedge to a cross member and a perspective view of a cast iron wedge usable with the embodiment.

As can therefore be seen, in FIG. 3A, the formed metal wedge 28 is constructed by a forming process of a metal material and is shaped, in the embodiment of FIG. 3A, to have a rectangular lateral cross section; however, other configurations of the cross section may be used. There is an open interior 30 and the formed metal wedge 28 can be affixed to a cross member 14 by means of rivets 32 or other fastening devices. An inset 34 is provided in the formed metal wedge 28 to receive the vertical flange 36 of the T-shaped cross member 14.

In FIG. 3B, taken along with FIG. 3A, there is a similarly shaped cast metal wedge 38 comprised of a cast metal and, again, are rivets 40 may be used to affix the cast metal wedge 38 firmly to a cross member 14. Again, an inset 42 is formed in the cast metal wedge 38 to accommodate the vertical flange 36 of the T-shaped cross member 14.

Figure 4A:
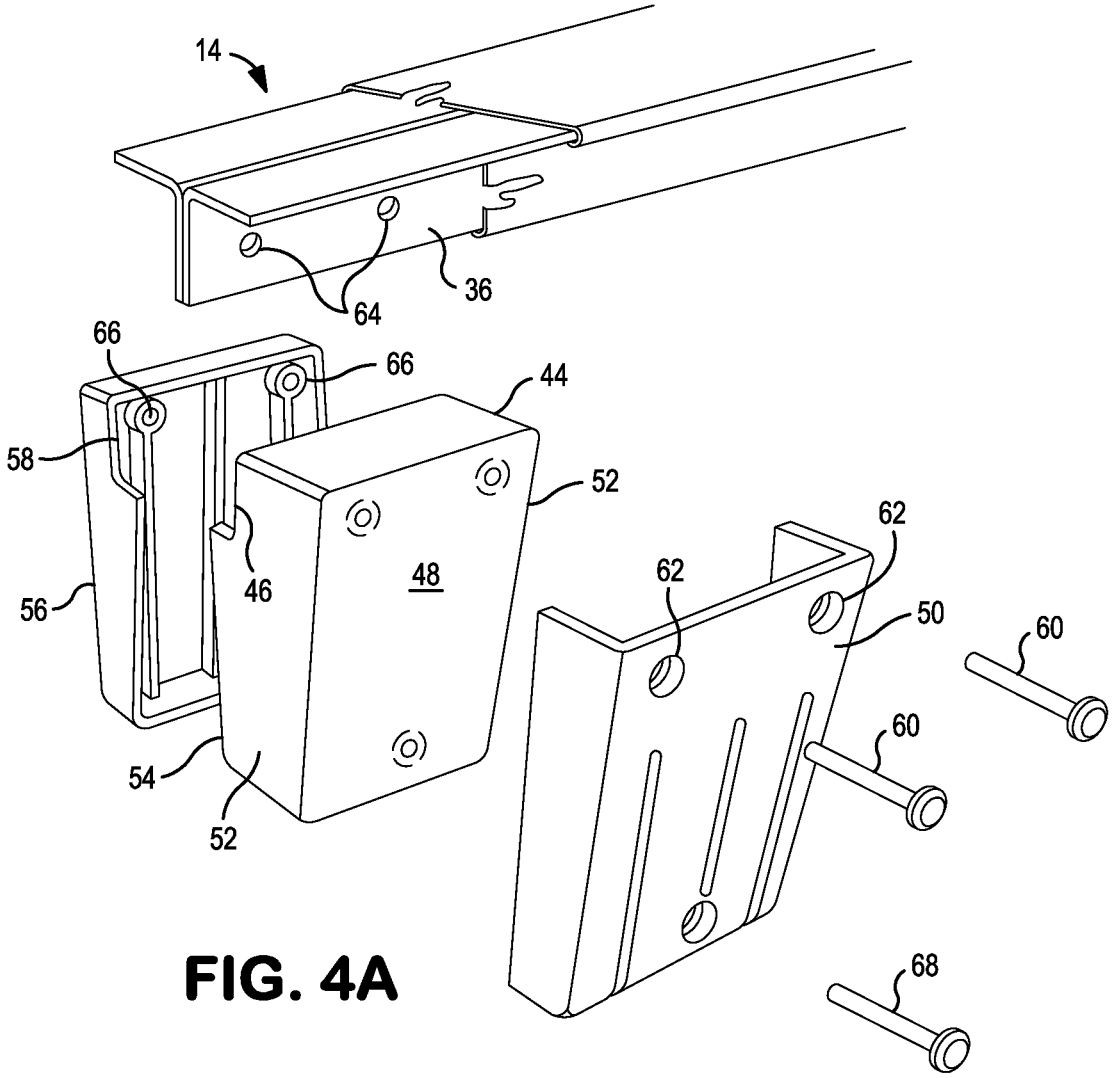
FIG. 4A is an exploded view of a second wedge embodiment of the present invention where the metal wedge is protected by a molded plastic cover and FIG. 4B is a cross sectional view of the FIG. 4A embodiment.
Figure 4B:
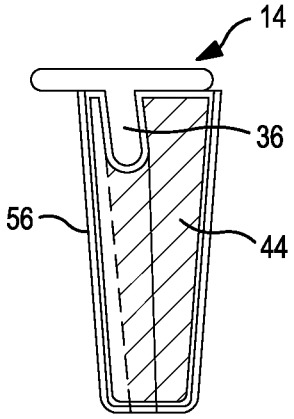

Turning then to FIG. 4A and FIG. 4B, there is, respectively, an exploded view and a cross sectional view, of a second embodiment of the present invention. In this embodiment, there is a metal wedge 44 that may be comprised of a formed metal or a cast metal material. In this embodiment, again there is an inset 46 formed in the inner surface of the metal wedge 44 for close contact with the vertical flange 36 of the T-shaped cross member 14.

An outer surface 48 of the metal wedge 44 is enclosed within a first molded plastic cover 50 such that the outer surface 48 and side surfaces 52 are protected by the first molded plastic cover 48. In like manner, the other outer surface 54 is enclosed within a second molded plastic cover 56 and the second molded plastic cover 56 includes an inset 58 for accommodating the vertical flange 36 of the cross member 14 so that the vertical flange 36 is sandwiched between the inset 46 of the metal wedge 44 and the inset 58 of the second molded plastic cover 56.

Rivets 60 are provided to pass through the holes 62 in the first molded plastic cover 50, the holes 64 in the vertical flange 36 and the holes 66 in the second molded plastic cover 56 to secure the metal wedge 44 to the cross member 14. Lastly, another rivet 68 is used to further secure the first and second molded plastic covers 50 and 56 to the metal wedge 44.

As thus can be seen, since many of the components of the bed frame 10 (FIG. 1) are covered with protective plastic covers, the metal wedge 44 is itself similarly covered to protect against the presence of sharp edges that could tear the bed coverings.

In FIG. 4B, there is a cross sectional view of the FIG. 4A embodiment and illustrating the sandwiching of the vertical flange 36 of the cross member 14 between the metal wedge 44 and the second molded plastic cover 56.

Figure 5:
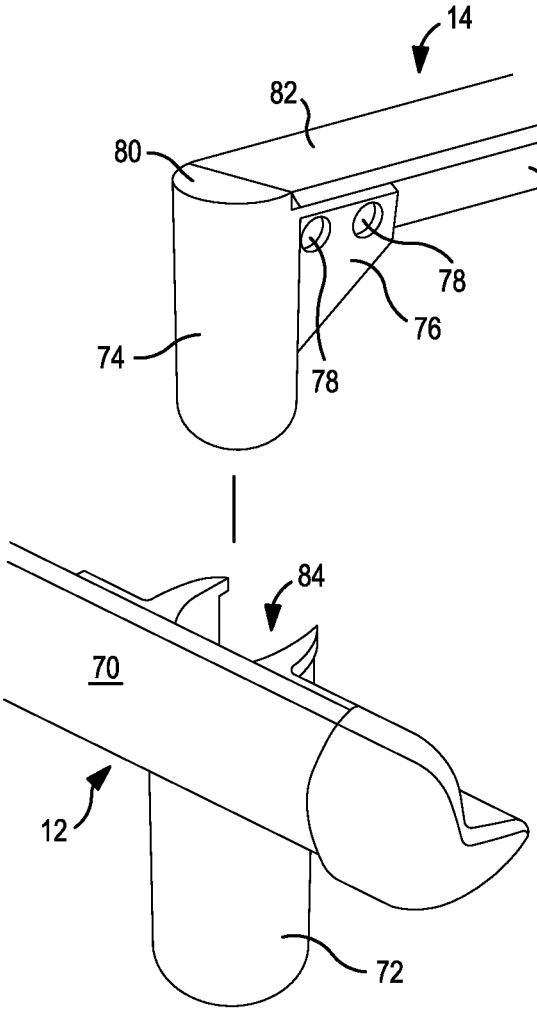
FIG. 5 is an exploded view illustrating the interfitting of a cylindrical wedge affixed to a cross member into a cylindrical receiver affixed to a side rail.
Figure 6:
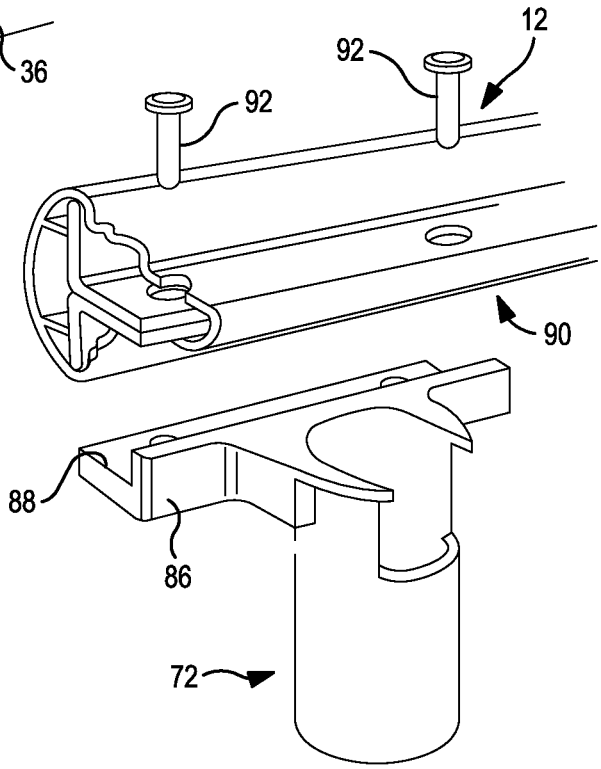
FIG. 6 is an exploded view showing the affixation of the receiver of the FIG. 5 embodiment to a side rail of a bed frame.

Turning then to FIGS. 5 and 6, there is an exploded view illustrating the connection system of the third embodiment and an exploded view illustrating the connection of a tubular receiver of that third embodiment to a side rail. Taking FIG. 5, there is shown a side rail 12 having a plastic protective cover 70. The tubular receiver 72 is affixed to the side rail 12 in a manner to be later explained.

The wedge, in this embodiment, is a tubular plug 74 that extends downwardly from the cross member 14 and, as can be seen, the tubular plug 74 has a flange 76 that may be affixed to the vertical flange 36 of the cross member 14 by means such as rivets 78. The upper surface of the flange 76 is depressed sufficiently from the upper surface 80 of the tubular plug 74 that the upper surface of the horizontal flange 82 is flush and level with the upper surface 80 of the tubular plug 74 to provide a finished appearance to the connection.

As is shown, the outer cross sectional configuration of the tubular plug 74 is circular, however, other geometric profiles could be used. The cylindrical tubular plug 74 is thus dimensioned to fit snugly into the cylindrical opening 84 of the tubular receiver 72.

Turning then to FIG. 6, the affixation of the tubular receiver 72 to the side rail 12 is illustrated. As shown, the tubular receiver 72 has a flange 86 extending generally horizontally and that flange 86 has a recessed upper surface 88 that contacts and fits against the horizontal flange 90 of the side rail 12. Again, rivets 92 can be used to complete the affixation of the tubular receiver 72 to the side rail 12.

Turning next to FIGS. 7, 8, and 9, there is an exploded view of the connection system of a fourth embodiment, an exploded view showing the affixation of the tube plug of this embodiment to a side rail and an alternative arrangement of a tubular receiver affixed to a cross member.

Accordingly, taking FIG. 7, there is shown a side rail 12 having a plastic cover 94 and a plastic end cap 96. A wedge in the form of a tube plug 98 extends downwardly from the side rail 12 in a manner to be described. As can be seen, the tube plug 98 is dimensioned so as to fit snugly into an opening 100 in a receiver 102 in order to carry out the connection of the side rail 12 and the receiver 102. The receiver 102 of this embodiment, is shaped to present a pleasing appearance, that is, rather than having a cylindrical outer shape, the receiver 102 has a specially curved outer surface.

On the upper surface 104 of the receiver 102, there is a groove 106 formed to receive the lower surface 108 of the side rail 12. As also can be seen, the receiver 102 has a rearward flange 110 that can be affixed to the vertical flange 36 of the cross member 14 by rivets 112 to affix the receiver 102 to the cross member 14.

In FIG. 8, there can be seen the means of affixing the tube plug 98 to the side rail 12 and, as shown, there are corresponding holes 114 in the side rail 12 that mate with holes 116 in the tube plug 98 and rivets 118 can be used to carry out the affixation.

In FIG. 9, there is an alternative receiver 120 where the receiver 120 is tubular in configuration and a recessed area 122 receives the lower surface of the side rail 12 (FIG. 7). Again, the receiver 120 has a flange 124 that can be used to accommodate rivets (not shown) to affix the receiver 120 to a cross member 14. The outer shape of the receiver 120 is a functional, cylindrical surface.

Figure 11:
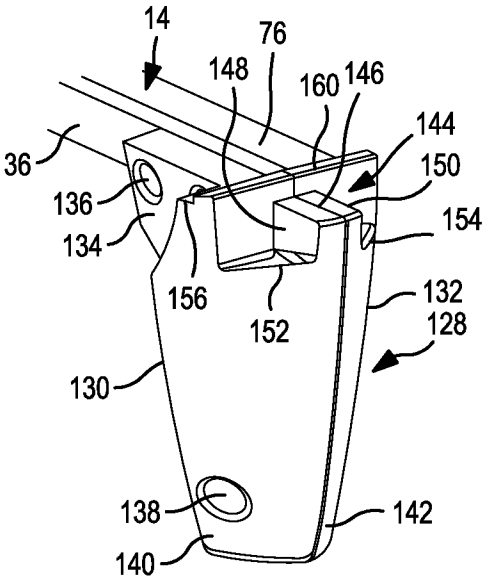
FIG. 11 is a perspective view of a receiver of the FIG. 10 embodiment.
Figure 10:
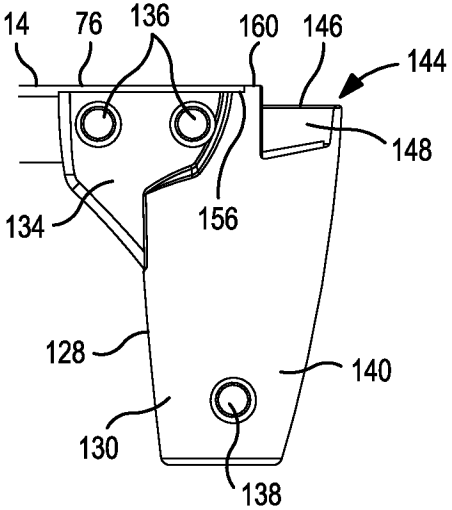
FIG. 10 is a side view of a still further embodiment wherein a receiver has multiple openings.

Turning then to FIGS. 10 and 11, there is a side view and a perspective view of a receiver 128 that is affixed to a cross member 14. In this embodiment, the receiver 128 is constructed of two halves, that is, there is a first half 130 and a second half 132 that are bought together to complete the receiver 128.

Each of the first and second halves 130, 132 has upper flanges and the first upper flange 134 for the first half 130 can be seen in FIGS. 10 and 11. The upper flange for the second half 132 cannot be seen, however, the first and second upper flanges sandwich the vertical flange 36 of the cross member 14. The first and second leg halves 130, 132 are held together with rivets, that is, there are two rivets 136 that join the upper first flange 134 and the second upper flange together as well as affix the receiver 128 to the cross member 14 and a third rivet 138 passes through the lower portions 140, 142 of the first and second halves 130, 132 to retain the first and second halves 130, 132 together.

As can be seen, particularly in FIG. 11, when the first and second halves 130, 132 of the receiver 128 are joined together, there is formed an upper saddle 144 having an upper surface 146 made up of the combined upper surfaces of the first and second halves 130, 132. Side surfaces 148, 150 extend downwardly from the upper surface 146 and are tapered outwardly, that is, away from each other, in the downward direction.

The geometric configuration of the upper saddle 144 is shown as a shape having surfaces defining multiple functional sides, similar to a truncated trapezoid, however, the shape of the upper saddle 144 may also be other shapes such as a cylindrical shape or other multi-surfaced shape. The shape of the upper saddle 144 could also be formed by as series of ribs to take the place of the solid surfaces.

As also can be seen in FIG. 11, there are two triangular openings formed in each half of the receiver 128. As such there is a first opening 152 and a second opening 154 formed in the first and second halves 130, 132 and the purpose of the first and second openings 152 and 154 will be later explained.

As a further feature of the present receiver 128, there is a slight inset 156 formed in the uppermost surface 160 and that inset 156 is dimensioned so that the upper horizontal flange 82 of the cross member 14 can sit flush with the uppermost surface 160 of the receiver 128.

Figure 12:
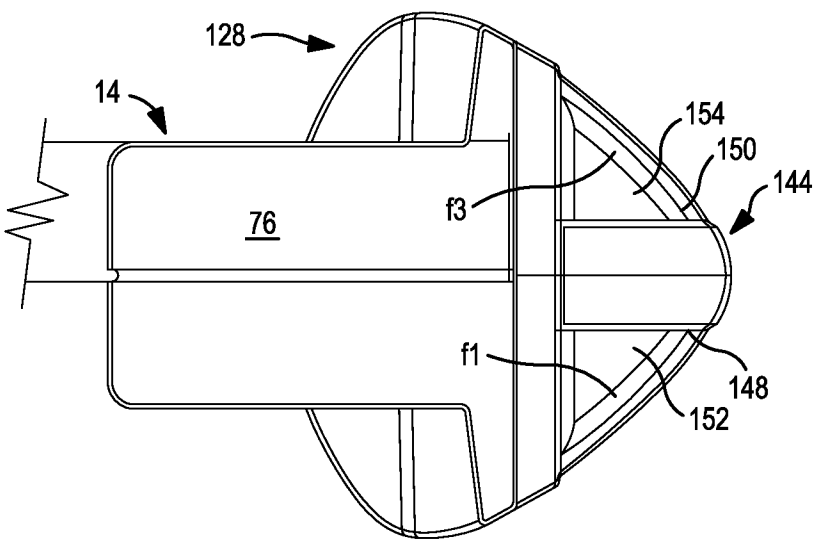
FIG. 12 is a top view of the receiver of the FIG. 10 embodiment.

Turning then to FIG. 12, there is a top view of receiver 128 affixed to a cross member 14. As can be seen, the first and second openings 152, 154 are spaced apart with the upper saddle 144 sandwiched therebetween. The slight outward taper of the side surfaces 148, 150 can be observed. The first and second openings 152, 154 are triangular in the illustrated embodiment, however, it can be seen that the openings could be cylindrical, triangular, rectangular or multi-sided in shape.

The first and second openings 152, 154 are formed so as to be wider at the top and narrower at the bottom, forming openings that are tapered inwardly in the downward direction.

Figure 13:
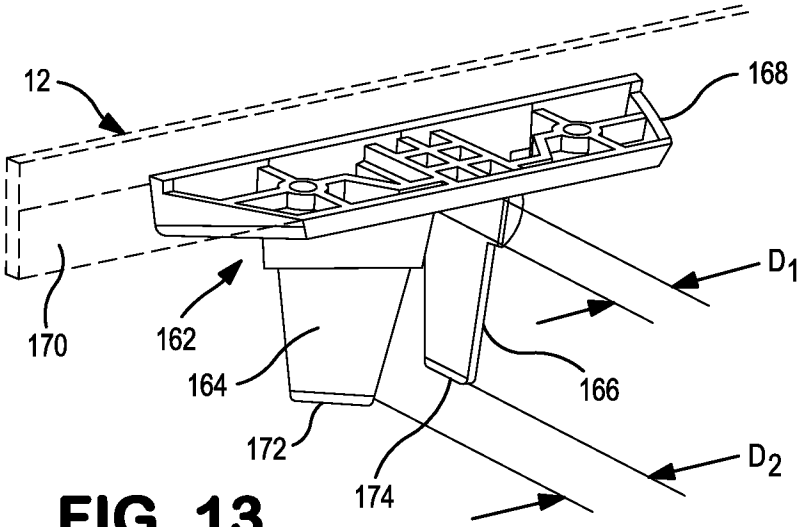
FIG. 13 is a perspective view showing the wedge having a plurality of wedge segments of the FIG. 10 embodiment.

Turning next to FIG. 13, taken along with FIG. 11, there is a perspective view of the wedge 162 that is useable with this embodiment. As can be seen, the wedge 162 has multiple wedge segments. There is a first wedge segment 164 and a second wedge segment 166 depending downwardly from a base portion 168 of the wedge 162. In the exemplary embodiment, two wedge segments are depicted, though more segments could also be used consistent with the intent of the present invention. The wedge 162 is riveted through its base portion 168 to a vertical flange 170 of a side rail 12.

The first and second segments 164, 166 are tapered inwardly in the downward direction with each segment being widest near the base portion 168 and tapering inwardly toward their distal ends 172, 174. This taper of the first and second wedge segments 164, 166, corresponds to the shape of the upper saddle 144 and tapers from a space equal to the distance D1 across the gap between the side surfaces 148, 150, at the top to less than a greater distance D2 across the gap at the bottom of the first and second openings 152, 154. The first and second openings 152, 154 are designed to interact with, align to, and tightly fit to the tapered first and second wedge segments 164, 166 when the wedge 162 is inserted into the receiver 128.

Figure 14:
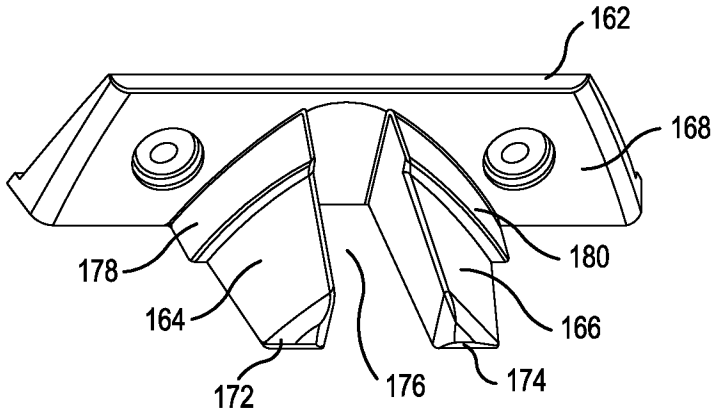
FIG. 14 is a perspective view illustrating the lower portion of the wedge of the FIG. 10 embodiment.

In FIG. 14, taken along with FIG. 11, there is a bottom perspective view of the wedge 162 wherein the triangular first and second wedge segments 164, 166 are illustrated extending from the base portion 168. Thus the gap 176 or space between the first and second wedge segments 164, 166 receives the upper saddle 144 and the taper of the side surfaces 148, 150 (FIG. 11) cause the first and second wedge segments 164, 166 to press inwardly against the first and second halves 130, 132 to force the first and second halves 130, 132 together as the connection is completed. As also can be seen in FIG. 14, there are enlarged upper raised portions 178, 180 that are ultimately positioned just below the cross member 14 (FIG. 11) to create a smooth appearance to the connection.

Figure 15:
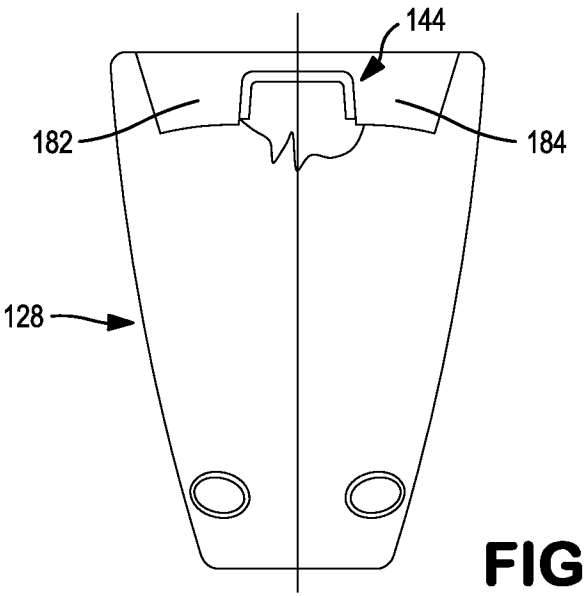
FIG. 15 is a side view of a receiver showing the forces on the saddle formed in the receiver in the FIG. 10 embodiment.

Turning now to FIG. 15, there is a side view of receiver 128 of this exemplary embodiment and showing the upper saddle 144. The formation of the upper saddle 144 requires the presence of open slots 182, 184 in the face of each of the first and second halves 130, 132 and the enlarged upper raised portions 178, 180 (FIG. 14) aesthetically fill in these open slots to provide a smooth, contiguous appearing leg surface when the first and second wedge segments 164, 166 are assembled together in forming the receiver 128

Figure 16:
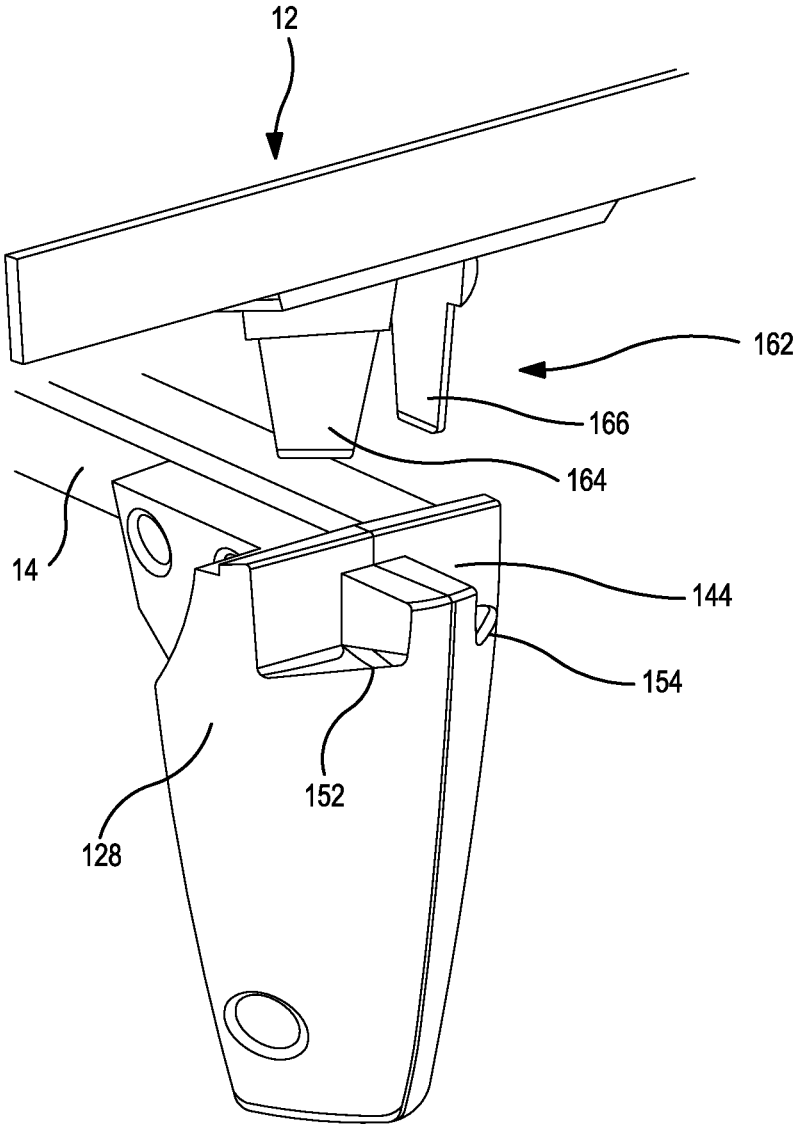
FIG. 16 is an exploded view showing the connection of a wedge and receiver carried out with the FIG. 10.

Turning next to FIG. 16, there is an exploded view illustrating the beginning of a connection between the wedge 162 and the receiver 128 in the exemplary embodiment. Accordingly, the side rail 14 is oriented directly above the cross member 14 so that the wedge 162 and the receiver 128 are in alignment. As the side rail 12 is then lowered, the first and second wedge segments 164, 166 can enter into the first and second openings 152, 154 in the receiver 128, bridging the upper saddle 144 to assemble the side rail 12 to the cross member 14.

Figure 17A:
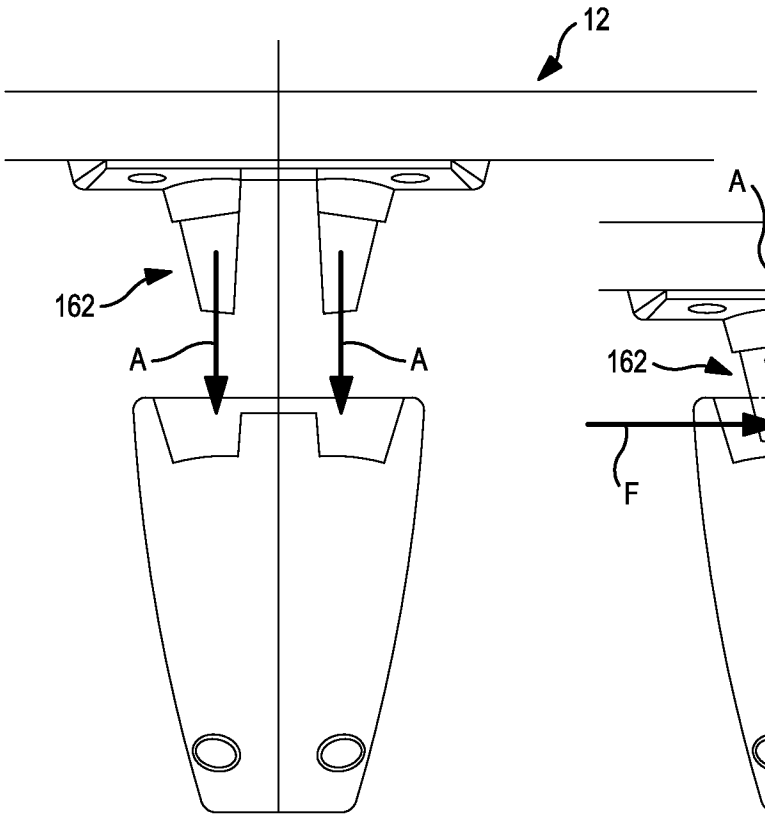
FIGS. 17A-17C are side views showing the progressive steps of inserting the wedge into the receiver of the FIG. 10 embodiment.
Figure 17B:
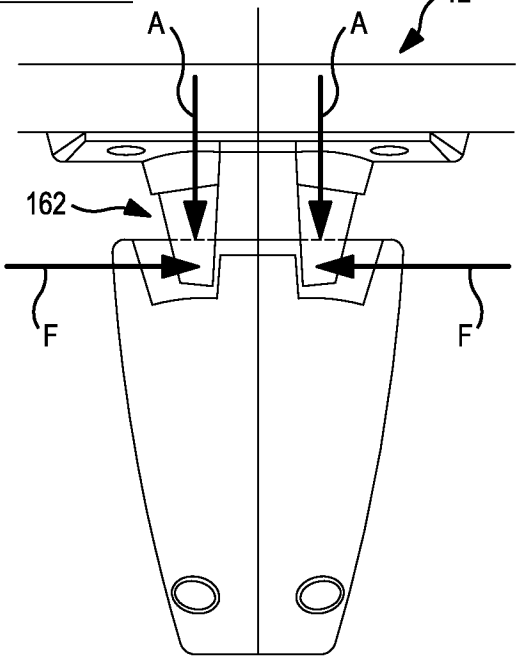
Figure 17C:
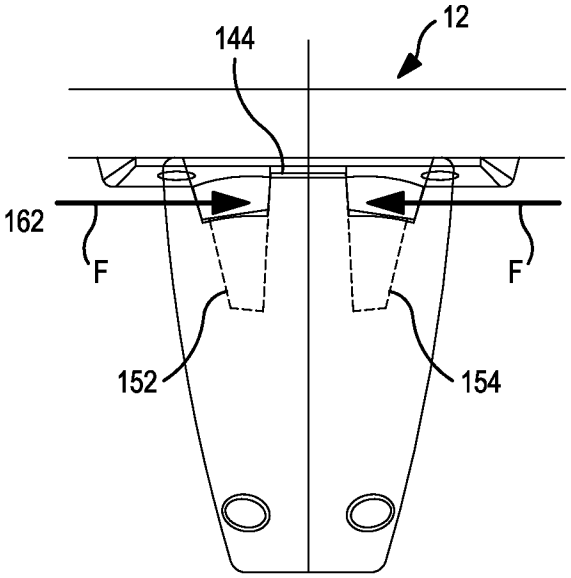

The progression of that assembly of the side rail 12 and the cross member (not shown) can further be seen in FIGS. 17A-17C where there are schematic views illustrating the steps of assembly. As such, in FIG. 17A, the side rail 12 having the wedge 162 affixed thereto is spaced above the receiver 128 and the side rail 12 is, in order to carry out a connection, lowered in the direction of the arrows A toward the receiver 128.

In FIG. 17B, the side rail 12 has been lowered in the direction of the arrows A such that the first and second wedge segments 164, 166 are entering into the first and second openings 152, 154, thereby creating forces in the direction of the arrows F inwardly against the upper saddle 144 to force and hold the first and second wedge segments 164, 166 forcefully together.

Finally, in FIG. 17C, the first and second wedge segments 164, 166 have fully entered into the first and second openings 152, 154 so that the side rail 12 is fully attached to the cross member resulting in a tight, friction fit between the side rail 12 and the cross member where the first and second wedge segments 164, 166 are forced tightly together.

Figure 18:
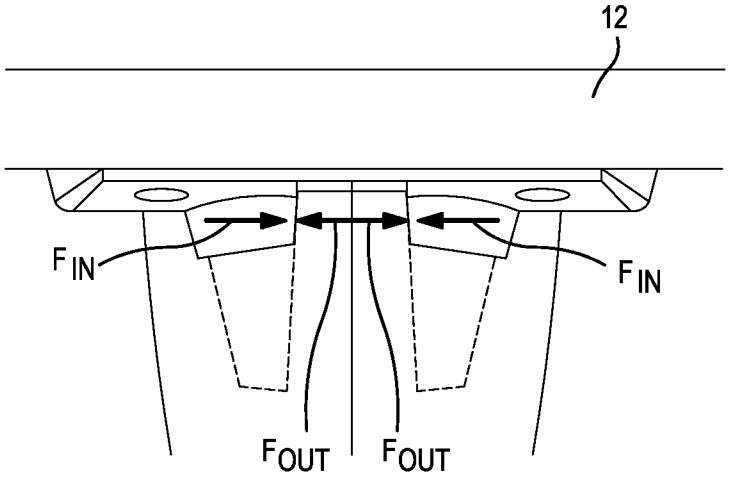
FIG. 18 is a schematic view illustrating the forces exerted along the inner surface of the upper saddle of the receiver in the FIG. 10 embodiment.

Turning then to FIG. 18, there is a schematic view illustrating the forces between the first and second wedge segments 164, 166 and the upper saddle 144 since the first and second wedge segments 164, 166 exerts an inward force $F_{in}$ and the upper saddle 144 creates outer forces $F_{out}$.

Figure 19:
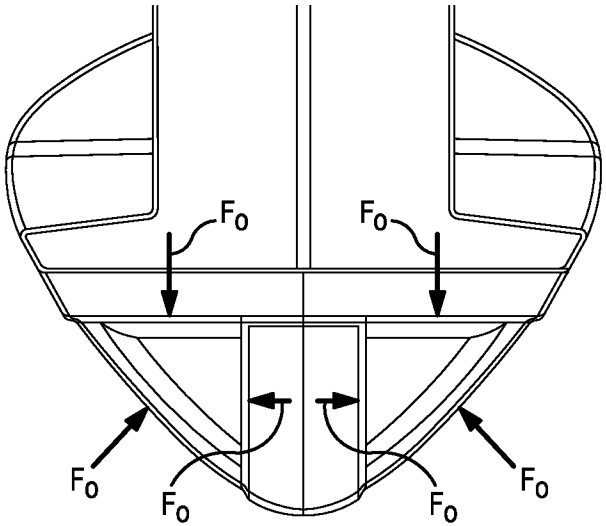
FIG. 19 is a schematic view illustrating the forces exerted by the wedge against the receiver in the FIG. 10 embodiment.

In FIG. 19, there is shown the forces $F_o$ exerted against the first and second wedge segments 164, 166 against the inner surfaces of the first and second openings 152,154.

Figure 20:
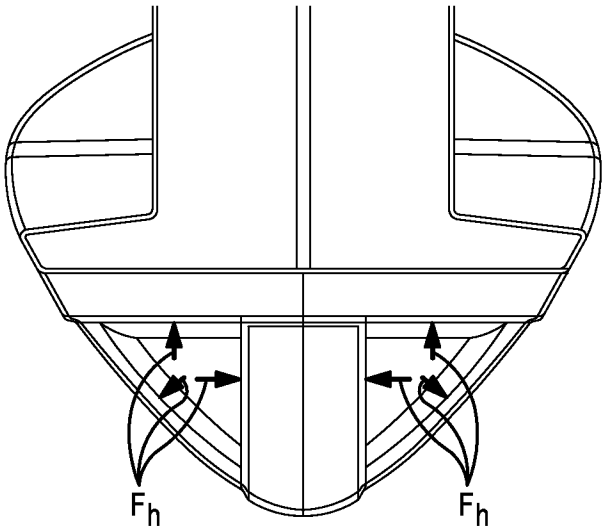
FIG. 20 is a schematic view illustrating the forces exerted by the receiver against the wedge in the FIG. 10 embodiment.

Lastly, in FIG. 20, there is shown the forces $F_h$ exerted by the first and second wedge segments 164, 166 against the inner surfaces of the first and second openings 52, 154 creating a self-aligning, secure, tight fitting, and tool-less friction-fit assembly of a bed side rail 12 to a cross member 14.

While the present invention has been set forth in terms of a specific embodiment or embodiments, it will be understood that the present three dimensional connection system for a bed frame herein disclosed may be modified or altered by those skilled in the art to other configurations. Accordingly, the invention is to be broadly construed and limited only by the scope and spirit of the claims appended hereto.

What is claimed:

1. A bed frame assembly for supporting a mattress or mattress set, the bed frame assembly comprising:

side rails and at least one cross member, the at least one cross member having at least two receivers affixed thereto the side rails having wedges at opposed ends thereof, wherein each receiver has an upper portion and an opposed bottom portion, wherein each receiver has a plurality of openings in the upper portion of the each receiver, the openings being in the form of slots, the slots being delimited a bottom slot surface in the upper portion of the each receiver, wherein each wedge comprises a plurality of wedge segments, each wedge segment having a distal end, wherein the distal end of each wedge segment is configured to be engagable with the bottom slot surface in the upper portion of each receiver whereby the wedge segments nest within the plurality of openings of the at least two receivers to join the at least one cross member to one of the side rails.

2. The bed frame assembly of claim 1 wherein each of the receivers are comprised of two halves, each half having one of the plurality of openings and together forming an upper saddle.

3. The bed frame assembly of claim 2 wherein the upper saddle has side surfaces that taper outwardly in the downward direction.

4. The bed frame assembly of claim 3 wherein the plurality of wedge segments that straddle the upper saddle to force the two halves of each receiver toward each other.

5. The bed frame assembly of claim 4 wherein the cross member has a vertical flange and the halves of each receiver have flanges that sandwich the vertical flange therebetween.

6. The bed frame assembly of claim 5 wherein the flanges are affixed to the vertical flange by rivets.

7. The bed frame assembly of claim 1 wherein the plurality of openings in each receiver taper inwardly in the downward direction.

8. The bed frame assembly of claim 1 wherein the plurality of wedge segments are triangular in lateral cross section.

9. The bed frame assembly of claim 1 wherein the plurality of wedge segments in each of the at least two wedges are two wedge segments and wherein the plurality of openings in the receivers are two openings in the receivers.

10. A bed frame assembly for supporting a mattress or mattress set, the bed frame assembly comprising:

side rails and at least one cross member, the at least one cross member having at least two wedges affixed thereto the side rails having receivers at opposed ends thereof, wherein each receiver has an upper portion and an opposed bottom portion, wherein each receiver has a plurality of openings in the upper portion of the each receiver, the openings being in the form of slots, the slots being delimited a bottom slot surface in the upper portion of the each receiver, wherein each wedge comprises a plurality of wedge segments, each wedge segment having a distal end, wherein the distal end of each wedge segment is configured to be engagable with the bottom slot surface in the upper portion of each receiver whereby the wedge segments nest within the plurality of openings of the receivers to join the at least one cross member to one of the side rails.

11. The bed frame assembly of claim 10 wherein each of the receivers are comprised of two halves, each half having one of the plurality of openings and together forming an upper saddle.

12. The bed frame assembly of claim 11 wherein the upper saddle has side surfaces that taper outwardly in the downward direction.

13. The bed frame assembly of claim 12 wherein the plurality of wedge segments that straddle the upper saddle to force the two halves of each receiver toward each other.

14. The bed frame assembly of claim 13 wherein the cross member has a vertical flange and the halves of each receiver have flanges that sandwich the vertical flange therebetween.

15. The bed frame assembly of claim 14 wherein the flanges are affixed to the vertical flange by rivets.

16. The bed frame assembly of claim 10 wherein the plurality of openings in each receiver taper inwardly in the downward direction.

17. The bed frame assembly of claim 10 wherein the plurality of wedge segments are triangular in lateral cross section.

18. The bed frame assembly of claim 10 wherein the plurality of wedge segments in each of the at least two wedges are two wedge segments and wherein the plurality of openings in the receivers are two openings in the receivers.

* * * * *